US006220387B1

(12) United States Patent
Hoppes et al.

(10) Patent No.: US 6,220,387 B1
(45) Date of Patent: Apr. 24, 2001

(54) EXHAUST MUFFLER

(76) Inventors: Mathew S. Hoppes, 6609 S. College Ave., Phoenix, AZ (US) 85283; Aaron C. Oster, 14616 N. 47th Pl.; Timothy L. Smith, 14402 N. 35th St., both of Phoenix, AZ (US) 85032

( * ) Notice: Subject to any disclaimer, the term of this patent is extended or adjusted under 35 U.S.C. 154(b) by 0 days.

(21) Appl. No.: 09/422,437

(22) Filed: Oct. 21, 1999

(51) Int. Cl.[7] ..... F01N 1/14

(52) U.S. Cl. ..... 181/259; 181/227; 181/228; 181/240; 181/255

(58) Field of Search ..... 181/227, 228, 181/240, 255, 259, 260, 262, 263

(56) References Cited

U.S. PATENT DOCUMENTS

| | | | | |
|---|---|---|---|---|
| 2,725,948 | * | 12/1955 | Keene | 181/43 |
| 3,690,105 | | 9/1972 | Faulkner | 60/283 |
| 4,050,903 | | 9/1977 | Bailey et al. | 23/288 |
| 4,265,332 | | 5/1981 | Presnall et al. | 181/211 |
| 4,361,206 | | 11/1982 | Tsai | 181/255 |
| 4,444,288 | * | 4/1984 | Sekiya et al. | 181/258 |
| 4,697,668 | | 10/1987 | Barker | 181/262 |
| 5,162,620 | * | 11/1992 | Ross et al. | 181/220 |
| 5,162,622 | * | 11/1992 | Malmsten | 181/227 |
| 5,248,859 | | 9/1993 | Borla | 181/238 |
| 5,371,331 | * | 12/1994 | Wall | 181/227 |
| 5,550,334 | | 8/1996 | Langley | 181/206 |
| 5,712,455 | * | 1/1998 | Wagner | 181/238 |
| 5,821,475 | | 10/1998 | Morehead et al. | 181/255 |
| 5,828,013 | * | 10/1998 | Wagner et al. | 181/255 |
| 5,969,299 | * | 10/1999 | Yamaguchi et al. | 181/227 |
| 5,971,097 | * | 10/1999 | Etheve | 181/227 |
| 6,089,348 | * | 7/2000 | Okor | 181/272 |

* cited by examiner

*Primary Examiner*—Robert E. Nappi
*Assistant Examiner*—Kim Lockett
(74) *Attorney, Agent, or Firm*—Lowell W. Gresham; Jordan M. Meschkow; Meschkow & Gresham, P.L.C.

(57) ABSTRACT

An exhaust muffler (20) for an internal combustion engine (25) includes a tapered tube (28) and an outer tube (40) axially aligned with and surrounding the tapered tube (28) so that an annular passage (42) is formed between the tapered tube (28) and the outer tube (40). The tapered tube (28) has an exhaust inlet end (30) for receiving exhaust gases (76) from the engine (25) and an exhaust outlet end (34). The outer tube (40) has an air inlet end (50) for receiving air (49) external to the engine and an air outlet end (52). The external air (49) flows in the annular passage (42) toward the air outlet end (52). The flow of the external air (49) creates a low pressure region (54) downstream of the exhaust outlet end (34) to accelerate the receipt of exhaust gases (76) from the engine, and elliptical holes (62) in the tapered tube (28) allow the smooth flow of exhaust gases (76) from tapered tube (28) to mix with the external air (49) to achieve effective noise attenuation.

20 Claims, 3 Drawing Sheets

EXHAUST MUFFLER

TECHNICAL FIELD OF THE INVENTION

The present invention relates generally to mufflers for attenuating the sound produced by the exhaust from internal combustion engines. More specifically, the present invention relates to mufflers that accelerate the flow of exhaust gases from internal combustion engines.

BACKGROUND OF THE INVENTION

In recent years, it has become increasingly necessary to provide improved mufflers for the attenuation of the exhaust noise produced by internal combustion engines used in transportation vehicles, due to public outcry and the resulting government regulations. New regulations are almost continually being proposed which require ever more stringent noise standards.

Many types of exhaust systems utilizing combinations of headers, collectors, and mufflers, as well as other noise reducing devices have been developed to address this problem. One type of exhaust system, generally referred to as a collector, combines and directs exhaust gases from separate exhaust tubes into a common downstream exhaust pipe. An exhaust muffler is attached downstream of the outlet pipe of the collector to effect noise reduction of the exhaust gases. Additionally, a catalytic converter may be attached to the exhaust system to convert some of the pollutants of the exhaust gases into harmless compounds. Unfortunately, such collector/muffler/catalytic converter systems are not very effective at minimizing the complexity of the exhaust system due to their many separate components. Moreover, they create back pressure which results in reduced performance of the engine. This reduced performance, or reduced horsepower, is undesirable in most vehicles.

Some muffler systems include sound attenuating material disposed in an space defined by an interior casing, or a tube structure, and an outer casing of the muffler. Holes or perforations in the interior casing, or tube structure, provide paths for the transmission of reflected high frequency components of noise into the sound attenuating material so that the noise can be subsequently dissipated. Unfortunately, this sound absorbing material adds to the overall weight of the muffler system, restricts the flow of exhaust, and provides a medium for the buildup of heat.

Thus, what is needed is An exhaust muffler that is lightweight, inexpensive, durable under attack of hot and corrosive exhaust gases, and impervious to vibration. Moreover, what is needed is An exhaust muffler that provides efficient noise attenuation while not causing undue back pressure to the engine, that is, one that provides good muffling without degrading engine performance.

SUMMARY OF THE INVENTION

Accordingly, it is an advantage of the present invention to provide an exhaust muffler for an internal combustion engine.

Another advantage of the present invention is to provide an exhaust muffler that accelerates the extraction of exhaust gases from the engine.

Another advantage of the present invention is to provide an exhaust muffler that achieves a cooling effect on the muffler and subsequently the engine.

Yet another advantage of the present invention is to provide an exhaust muffler that is economical in construction, lightweight, reliable in operation, rugged and able to withstand automotive racing along with normal use for extended periods.

The above and other advantages of the present invention are carried out in one form by An exhaust muffler for an internal combustion engine. The muffler includes a tapered tube having an exhaust inlet end exhibiting a first diameter and an exhaust outlet end exhibiting a second diameter, the second diameter being less than the first diameter. The exhaust inlet end is configured to receive exhaust gases from the engine. An outer tube is axially aligned with and surrounds the tapered tube to form an annular passage between the tapered tube and the outer tube. The outer tube has an air inlet end and an air outlet end. The air inlet end is configured to receive air external to the engine to create an air flow in the annular passage for accelerating the receipt of exhaust gases from the engine.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
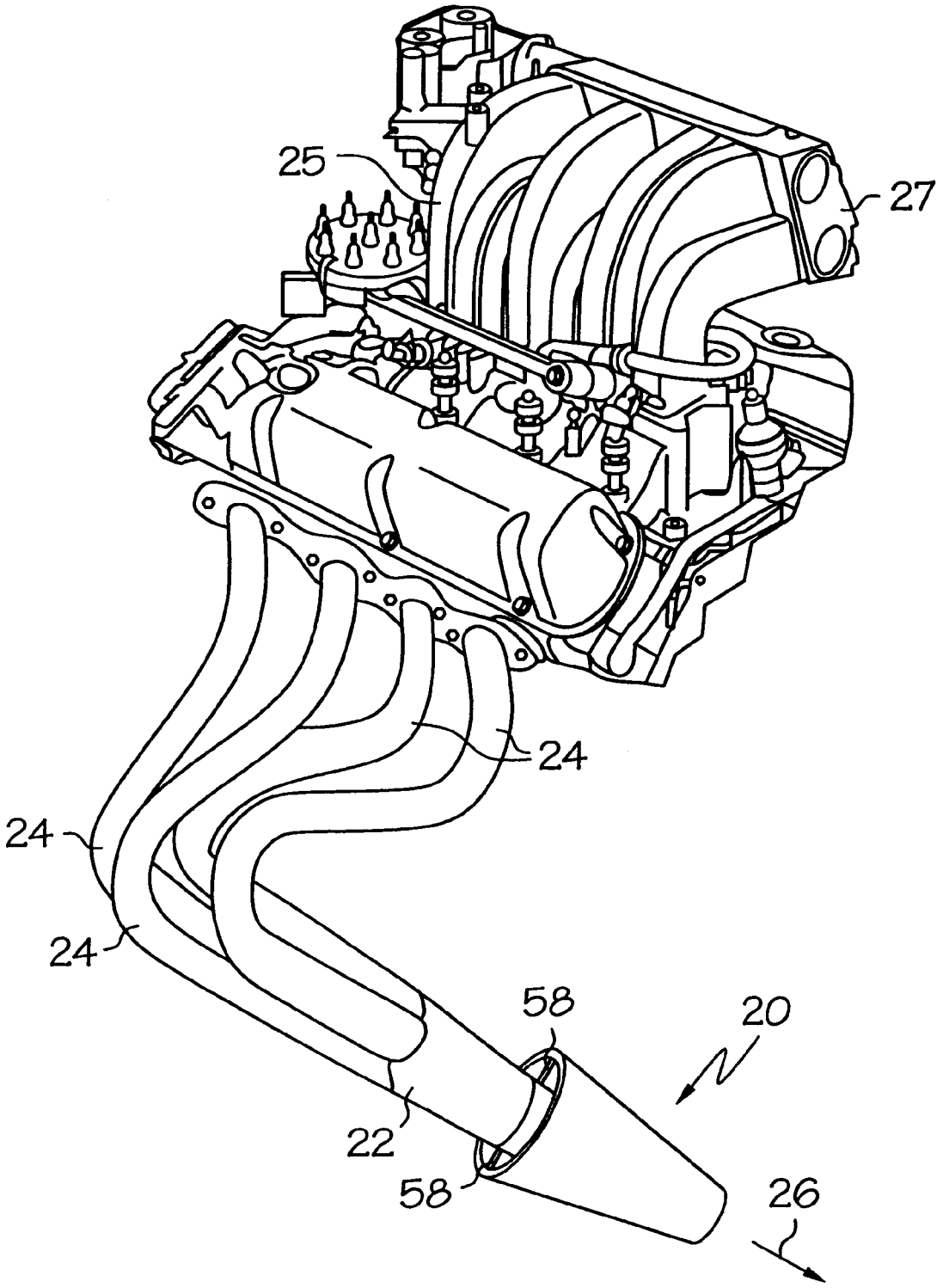
FIG. 1 shows a perspective view of an exhaust muffler in accordance with the present invention.

FIG. 1 shows a perspective view of an exhaust muffler 20 in accordance with the present invention. Muffler 20 is shown coupled to a collector 22 which is secured to a plurality of exhaust tubes 24 each communicating and sealingly engaging with the upstream end of collector 22. Exhaust tubes 24 are coupled to separate associated engine exhaust ports of an internal combustion engine 25.

During operation, air is drawn into an intake manifold 27 of internal combustion engine 25 and directed into the internal combustion engine cylinders. The air drawn into intake manifold 27 mixes with fuel to enable the combustion process in the cylinders (not shown) of engine 25 in a conventional manner. The resulting product of this combustion process is exhaust gas which is discharged from the cylinders. These exhaust gases are subsequently received by exhaust tubes 24 (FIG. 1) and collected at collector 22 (FIG. 1). In the preferred embodiment, the exhaust gases pass from collector 22 through muffler 20 and are exhausted from muffler 20 at the rear of a vehicle (not shown), as a mixture of exhaust gases and air external to the internal combustion engine. This mixture of exhaust gases and external air is indicated generally by an arrow 26, and will be described in detail below.

Exhaust tubes 24 and collector 22 are configured for attachment to an internal combustion engine of an automobile configured for racing. However, nothing in the present invention requires such a configuration. Rather, muffler 20 may be secured directly to the single exhaust tube of a conventional automobile, truck, van, motorcycle, speed boat, airplane, and the like.

Figure 2:
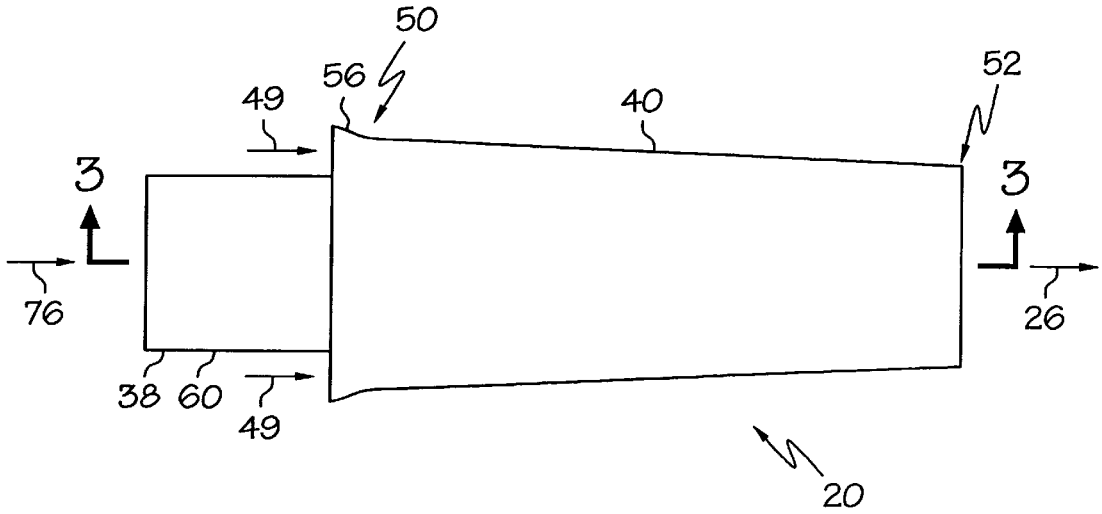
FIG. 2 shows a side view of the exhaust muffler.
Figure 3:
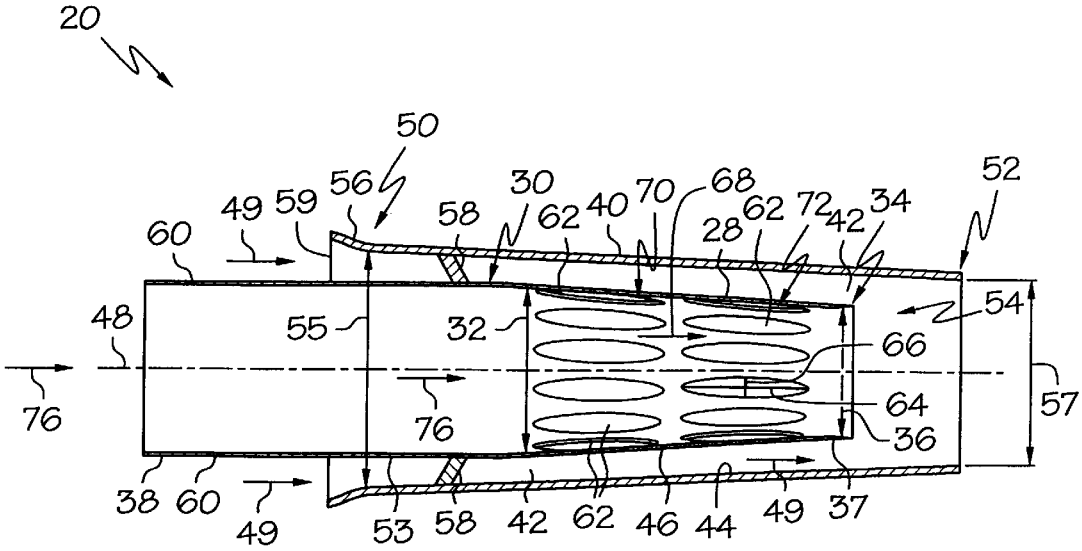
FIG. 3 shows a sectional view of the exhaust muffler along line 3—3 in FIG. 2.

Referring to FIGS. 2–3, FIG. 2 shows a side view of exhaust muffler 20 and FIG. 3 shows a sectional view of exhaust muffler 20 along line 3—3 in FIG. 2. Muffler 20 includes a tapered tube 28 having an exhaust inlet end 30 exhibiting a first diameter 32 and an exhaust outlet end 34 exhibiting a second diameter 36. A wall portion 37 of tapered tube 28 is located between exhaust inlet end 30 and exhaust outlet end 34.

A straight tube 38 having an invariant diameter substantially equal to first diameter 32 is coupled to exhaust inlet end 30 of tapered tube 28. Straight tube 38 is adapted for coupling to the exhaust outlet end of collector 22 (FIG. 1). This coupling may be achieved by welding, fasteners, crimping, coupling collar or fitting, or any other such mechanism that does not substantially interrupt the flow of exhaust gases from collector 22 (FIG. 1) into straight tube 38.

Muffler 20 also includes an outer tube 40 surrounding tapered tube 28 to form an annular passage 42 between an inner surface 44 of outer tube 40 and an outer surface 46 of tapered tube 28. Outer tube 40, tapered tube 28, and straight tube 38 are aligned about a common axis 48, and an air inlet end 50 of outer tube 40 is disposed proximate exhaust inlet end 30 of tapered tube 28. Likewise, an air outlet end 52 of outer tube 40 is disposed proximate exhaust outlet end 34 of tapered tube 28. Air inlet end 50 is configured to receive air external to the internal combustion air, indicated generally by arrows 49, to create a flow of external air 49 through annular passage 42 toward air outlet end 52.

In a preferred embodiment, outer tube 40 is longer than tapered tube 28 so that outer tube 40 extends upstream from exhaust inlet end 30 of tapered tube 28 to surround a section 53 of straight tube 38. Correspondingly, outer tube 40 extends downstream from exhaust outlet end 34 to form a hollow region 54 delineated by exhaust outlet end 34, air outlet end 52 and inner surface 44 of outer tube 40.

In the preferred embodiment, outer tube 40 is a reducing tube. In other words, a first tube diameter 55 of outer tube 40 at air inlet end 50 is greater than a second tube diameter 57 of outer tube 40 at air outlet end 52. In addition, outer tube 40 further includes a reducing bell 56 coupled to air inlet end 50. A mouth 59 of reducing bell 56 has a diameter that is greater than first tube diameter 55. The purpose of reducing bell 56 and reducing outer tube 40 will be explained in detail below.

A plurality of fins 58 and/or structural supports extends from an outer surface 60 of straight tube 38. Fins 58 are configured to be removably secured to inner surface 44 of outer tube 40 to maintain outer tube 40 and tapered tube 28, which is coupled to straight tube 38, concentric. Fins 58 may be secured to inner surface 44 by threaded fasteners (not shown). Alternatively, fins 58 may be welded to inner surface 44. In addition, fins 58 are strategically sized so as to permit a substantially unrestricted flow of external air 49 into annular passage 42.

Wall portion 37 of tapered tube 28 includes a plurality of elliptical holes 62. Each of elliptical holes 62 is characterized by a major axis 64 and a minor axis 66, the major axis being longer than the minor axis. Each of elliptical holes 62 is positioned on tapered tube 28 such that its major axis 64 is substantially aligned with a longitudinal dimension of tapered tube 28, generally referred to by an arrow 68.

A first subset of elliptical holes 62 is arranged in a first row 70 encircling the circumference of tapered tube 28. Likewise, a second subset of elliptical holes 62 is arranged in a second row 72 encircling the circumference of tapered tube 28.

Figure 4:
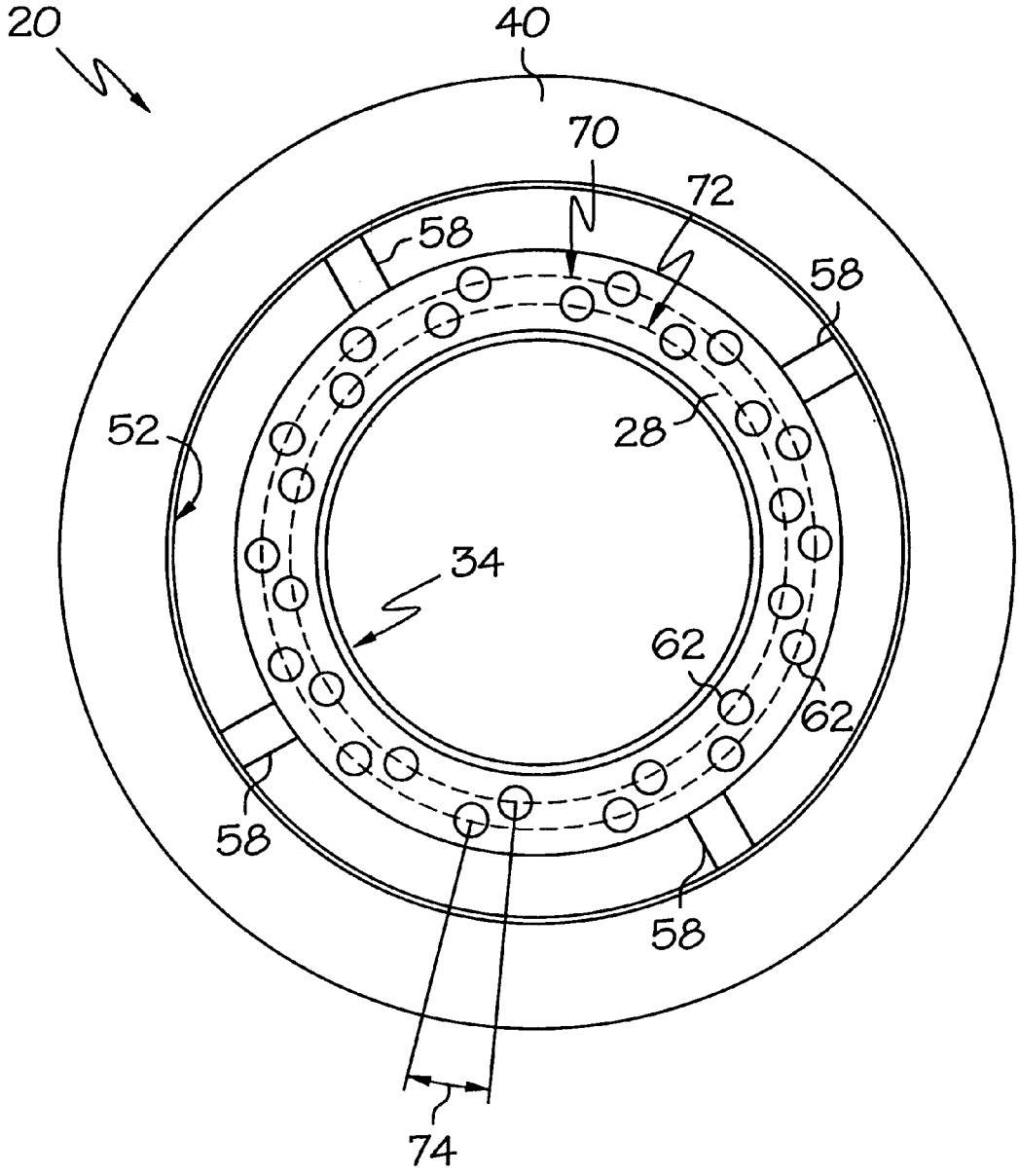
FIG. 4 shows a posterior view of the exhaust muffler as viewed at an exhaust outlet end of the muffler.

Referring to FIG. 4 in connection with FIG. 3, FIG. 4 shows a posterior view of exhaust muffler 20, as observed at air outlet end 52 of muffler 20. As best seen in FIG. 4, second row 72 is offset relative to first row 70 such that the center points of holes 62, i.e., the intersection of major and minor axes 62 and 64, respectively, of second row 72 are shifted a circumferential distance 74 relative to the center points of corresponding ones of holes 62 of first row 70. In addition, major axis 64 and minor axis 66 of each of elliptical holes 62 are dimensioned so that when muffler 20 is viewed at air outlet end 52, each of elliptical holes 62 appear as circles. Elliptical holes 62 may be formed by drilling through wall portion 37 of tapered tube 28 in a direction substantially perpendicular to the cross-section of tapered tube 28 to achieve the circular posterior appearance. Alternatively, elliptical holes 62 may be formed by laser cutting, electric discharge machine (EDM) cutting, water jet, and so forth.

In a preferred embodiment, tapered tube 28, straight tube 38, and fins 58 are machined from stainless steel and outer tube 40 is manufactured from aluminum or stainless steel. Consequently, the resulting assembly is inexpensive to manufacture, lightweight, durable under attack of hot and corrosive exhaust gases, and substantially impervious to vibration.

Referring back to FIG. 1–3 and as described previously, during operation internal combustion engine 25 draws air into an intake manifold 27 and directs a major portion of the air through the internal combustion engine cylinders. Exhaust gases discharged from the cylinders are received by exhaust tubes 24 (FIG. 1) which ae subsequently collected at collector 22 (FIG. 1). These exhaust gases, indicated generally by an arrow 76, are received in straight tube 38. Exhaust gases 76 are directed through straight tube 38 and into tapered tube 28 where exhaust gases 76 subsequently exit tapered tube 28 through holes 62 and exhaust outlet end 34 into region 54.

When a vehicle, in which the engine located, is stationary or operating at a moderate speed, the pressure of the hot exhaust gases 76 discharging from exhaust outlet end 34 is reduced as exhaust gases 76 enter hollow region 54. In other words, hollow region 54 located downstream from exhaust outlet end 34 of tapered tube 28, exhibits a gas pressure that is less than a gas pressure upstream in tapered tube 28 proximate exhaust inlet end 30. The result is a substantial increase in velocity of exhaust gases 76 as they leave tapered tube 28. This high velocity exhaust gas 76 causes external air 49 to be drawn into reducing bell 56 to create a substantial flow of external air 49 through annular passage 42 toward air outlet end 52. External air 49 and exhaust gases 76 mingle as exhaust gases flow from holes 62 and exhaust outlet end 34 of tapered tube 28. This mixture of gases 26 is subsequently discharged from air outlet end 52 of outer tube 40.

The structure of tapered tube 28 and the offset row configuration of elliptical holes 62 allows a smooth flow of exhaust gases 76 from tapered tube 28 to be mixed with external air 49. In other words, exhaust gases 76 do not substantially change direction as they are directed through tapered tube 28. The smooth flow of exhaust gases 76 from elliptical holes 62 and the mixing action of the hot exhaust gases 76 with the cooler external air 49 results in effective noise attenuation of the high pressure sound wave produced when exhaust valves (not shown) open. Moreover, elliptical holes 62 achieve the benefit of substantially reventing backflow of exhaust gases back into the internal combustion engine which has the undesirable affect of degrading engine performance.

In addition to preventing undesirable backflow, an additional benefit of the cooperative relationship between outer tube 40 and tapered tube 28 is the ability of muffler 20 to draw exhaust gases 76 from the internal combustion engine. Reducing bell 56 and air inlet end 50 of outer tube 40 face forward relative to the vehicle, and exhaust mixture 26 is discharged rearward relative to the vehicle. Accordingly, as the vehicle moves faster, more external air 49 is captured by reducing bell 56 and rammed into annular passage 42.

In addition, the structure of reducing bell 56 and the tapered configuration of outer tube 40 serve to further increase the velocity of external air 49. The velocity of external air 49 flowing through annular passage 42 into hollow region 54 approaches the velocity of exhaust gases 76 being discharged from tapered tube 28. The result is a greater pressure differential between the pressure in hollow region 54 and the pressure in tapered tube 28. The consequence of this greater pressure differential is to accelerate the receipt of exhaust gases 76 from the engine and increase engine power as external air flow velocity increases due to increased vehicle speed. The accelerated receipt of exhaust gases 76 from the engine causes the engine to run cooler. In other words, the hot exhaust gases 76 are discharged quickly before the heat of exhaust gases 76 can be transferred to the engine components, thus reducing engine wear.

Tests have indicated, however, that there is a desired relationship between first diameter 32 of exhaust inlet end 30 and first tube diameter 55 of air inlet end 50 for effectively accelerating receipt of exhaust gases 76 from the engine. In other words, the difference between first diameter 32 and first tube diameter 55 is equivalent to the width of annular passage 42. Tests have indicated that if the width of annular passage 42 is too great, the resulting velocity of external air 49 flowing through annular passage 42 is too high, resulting in the undesirable backflow of exhaust gases 76 into the engine. However, if the width of annular passage 42 is too small, the benefit of accelerating the receipt of exhaust gases will not be achieved. Accordingly, tests have determined that when first diameter 32 of exhaust inlet end 30 is in a range of approximately fifteen to forty percent smaller than first tube diameter 55, effective acceleration of exhaust gases 76 is achieved without the undesirable effect of backflow.

In summary, the present invention teaches of an exhaust muffler for an internal combustion engine. The exhaust muffler draws air external to the internal combustion engine along an annular passage surrounding a tapered tube configured to receive exhaust gases from the engine. The velocity of the external air produces a low pressure region downstream of the exhaust gases to accelerate the extraction of exhaust gases from the engine. The accelerated extraction of exhaust gases achieves a cooling effect on the muffler and subsequently the engine by drawing out the hot exhaust gases before heat is transferred from the exhaust gases back to the engine. In addition, exhaust gases smoothly flow through elliptical holes located in the tapered tube to mix with the external air. This smooth flow and effective mixing results in noise attenuation without the undesirable effect of backflow of exhaust gases into the engine. The structure of the exhaust muffler is economical in construction, lightweight, reliable in operation, rugged and able to withstand automotive racing use for extended periods.

Although the preferred embodiments of the invention have been illustrated and described in detail, it will be readily apparent to those skilled in the art that various modifications may be made therein without departing from the spirit of the invention or from the scope of the appended claims. For example, the exhaust muffler may be used with a catalytic converter system. In addition, the elliptical holes in the exhaust muffler may be configured as circular holes. Alternatively, the elliptical holes may be absent from the tapered tube. Such a configuration would still result in noise attenuation, although, perhaps at the expense of decreased engine performance due to the increased potential for backflow.

What is claimed is:

1. An exhaust muffler for an internal combustion engine comprising:

a tapered tube having an exhaust inlet end exhibiting a first diameter and an exhaust outlet end exhibiting a second diameter, said second diameter being less than said first diameter, and said exhaust inlet end being configured to receive exhaust gases from said engine; and an outer tube axially aligned with and surrounding said tapered tube to form an annular passage between said tapered tube and said outer tube, said outer tube having an air inlet end and an air outlet end, said air inlet end being configured to receive air external to said engine to create a flow of said external air in said annular passage toward said air outlet end for accelerating the receipt of exhaust gases from said engine.

2. An exhaust muffler as claimed in claim 1 wherein a wall portion of said tapered tube includes a plurality of holes for passage of said exhaust gases out of said tapered tube, said holes enabling said exhaust gases to mix with said external air flowing through said annular passage to said air outlet end.

3. An exhaust muffler for an internal combustion engine comprising:

a tapered tube including:

an exhaust inlet end exhibiting a first diameter and configured to receive exhaust gases from said engine;

an exhaust outlet end exhibiting a second diameter, said second diameter being less than said first diameter; and a wall portion having a plurality of holes for passage of said exhaust gases out of said tapered tube, each of said holes being an ellipse characterized by a major axis and a minor axis, said major axis being greater than said minor axis, and said major axis being substantially aligned with a longitudinal dimension of said tapered tube; and an outer tube axially aligned with and surrounding said tapered tube to form an annular passage between said tapered tube and said outer tube, said outer tube having an air inlet end and an air outlet end, said air inlet end being configured to receive air external to said engine to create a flow of said external air in said annular passage toward said air outlet end for accelerating the receipt of exhaust gases from said engine, said holes of said wall portion enabling said exhaust gases to mix with said external air flowing through said annular passage to said air outlet end.

4. An exhaust muffler as claimed in claim 3 wherein said ellipse is dimensioned such that a posterior appearance of said each ellipse, as viewed at said exhaust outlet end of said tapered tube, approximates a circle.

5. An exhaust muffler as claimed in claim 2 wherein:

a first subset of said holes is arranged in a first row encircling a circumference of said tapered tube; and a second subset of said holes is arranged in a second row encircling said circumference of said tapered tube, said second row being offset relative to said first row such that center points of said holes of said second subset are shifted about said circumference relative to center points of corresponding ones said holes of said first subset.

6. An exhaust muffler for an internal combustion engine comprising:

a tapered tube having an exhaust inlet end exhibiting a first diameter and an exhaust outlet end exhibiting a second diameter, said second diameter being less than said first diameter, and said exhaust inlet end being configured to receive exhaust gases from said engine;

an outer tube axially aligned with and surrounding said tapered tube to form an annular passage between said tapered tube and said outer tube, said outer tube having an air inlet end and an air outlet end, said air inlet end being configured to receive air external to said engine to create a flow of said external air in said annular passage toward said air outlet end for accelerating the receipt of exhaust gases from said engine; and a straight tube of substantially invariant diameter coupled to said exhaust inlet end of said tapered tube, said straight tube being axially aligned with said tapered tube.

7. An exhaust muffler as claimed in claim 1 wherein said outer tube is oriented so that said air inlet end is disposed proximate said exhaust inlet end of said tapered tube and said air outlet end is disposed proximate said exhaust outlet end of said tapered tube.

8. An exhaust muffler for an internal combustion engine comprising:

a tapered tube having an exhaust inlet end exhibiting a first diameter and an exhaust outlet end exhibiting a second diameter, said second diameter being less than said first diameter, and said exhaust inlet end being configured to receive exhaust gases from said engine; and an outer tube axially aligned with and surrounding said tapered tube to form an annular passage between said tapered tube and said outer tube, said outer tube having an air inlet end disposed proximate said exhaust inlet end of said tapered tube and an air outlet end disposed proximate said exhaust outlet end of said tapered tube, said air inlet end being configured to receive air external to said engine to create a flow of said external air in said annular passage toward said air outlet end for accelerating the receipt of exhaust gases from said engine, and said first diameter of said exhaust inlet end being in a range of approximately fifteen to forty percent smaller than a diameter of said air inlet end of said outer tube.

9. An exhaust muffler for an internal combustion engine comprising:

a tapered tube having an exhaust inlet end exhibiting a first diameter and an exhaust outlet end exhibiting a second diameter, said second diameter being less than said first diameter, and said exhaust inlet end being configured to receive exhaust gases from said engine; and an outer tube axially aligned with and surrounding said tapered tube to form an annular passage between said tapered tube and said outer tube, said outer tube having an air inlet end disposed proximate said exhaust inlet end of said tapered tube and an air outlet end disposed proximate said exhaust outlet end of said tapered tube, said air inlet end being configured to receive air external to said engine to create a flow of said external air in said annular passage toward said air outlet end for accelerating the receipt of exhaust gases from said engine, and said outer tube extending downstream from said exhaust outlet end of said tapered tube to form a region delineated by said exhaust outlet end, said air outlet end, and an inner surface of said outer tube.

10. An exhaust muffler as claimed in claim 9 wherein said region exhibits a downstream gas pressure that is less than an upstream gas pressure in said tapered tube proximate said exhaust inlet end.

11. An exhaust muffler for an internal combustion engine comprising:

a tapered tube having an exhaust inlet end exhibiting a first diameter and an exhaust outlet end exhibiting a second diameter, said second diameter being less than said first diameter, and said exhaust inlet end being configured to receive exhaust gases from said engine;

a straight tube of substantially invariant diameter coupled to said exhaust inlet end of said tapered tube; and an outer tube axially aligned with and surrounding said tapered tube to form an annular passage between said tapered tube and said outer tube, said outer tube extending upstream from said exhaust inlet end of said tapered tube to surround a section of said straight tube, said outer tube having an air inlet end disposed proximate said exhaust inlet end of said tapered tube and an air outlet end disposed proximate said exhaust outlet end of said tapered tube, said air inlet end being configured to receive air external to said engine to create a flow of said external air in said annular passage toward said air outlet end for accelerating the receipt of exhaust gases from said engine.

12. An exhaust muffler for an internal combustion engine comprising:

a tapered tube having an exhaust inlet end exhibiting a first diameter and an exhaust outlet end exhibiting a second diameter, said second diameter being less than said first diameter, and said exhaust inlet end being configured to receive exhaust gases from said engine; and an outer tube axially aligned with and surrounding said tapered tube to form an annular passage between said tapered tube and said outer tube, said outer tube having an air inlet end and an air outlet end, said outer tube being a reducing tube exhibiting a first tube diameter at said air inlet end and a second tube diameter at said air outlet end, said second tube diameter being less than said first tube diameter, and said air inlet end being configured to receive air external to said engine to create a flow of said external air in said annular passage toward said air outlet end for accelerating the receipt of exhaust gases from said engine.

13. An exhaust muffler for an internal combustion engine comprising:

a tapered tube having an exhaust inlet end exhibiting a first diameter and an exhaust outlet end exhibiting a second diameter, said second diameter being less than said first diameter, and said exhaust inlet end being configured to receive exhaust gases from said engine;

an outer tube axially aligned with and surrounding said tapered tube to form an annular passage between said tapered tube and said outer tube, said outer tube having an air inlet end and an air outlet end, said air inlet end being configured to receive air external to said engine to create a flow of said external air in said annular passage toward said air outlet end for accelerating the receipt of exhaust gases from said engine; and a reducing bell coupled to said air inlet end of said outer tube for receiving said external air and communicating said air to said annular passage.

14. An exhaust muffler as claimed in claim 1 further comprising means for removably securing said outer tube to said tapered tube, said removably securing means permitting substantially unrestricted flow of said external air in said annular passage.

15. An exhaust muffler as claimed in claim 14 wherein:

said muffler further comprises a straight tube coupled to said exhaust inlet end of said tapered tube; and said securing means includes fins extending from an inner surface of said outer tube, said fins being configured to attach to an outer surface of said tapered tube proximate said exhaust inlet end.

16. An exhaust muffler for an internal combustion engine comprising:

a tapered tube including:

an exhaust inlet end exhibiting a first diameter and configured to receive exhaust gases;

an exhaust outlet end exhibiting a second diameter, said second diameter being less than said first diameter; and a wall portion located between said exhaust inlet end and said exhaust outlet end, said wall portion having a plurality of holes; and an outer tube axially aligned with and surrounding said tapered tube to form an annular passage between said tapered tube and said outer tube, said outer tube having an air inlet end proximate said exhaust inlet end and an air outlet end proximate said exhaust outlet end, said air inlet end being configured to receive air external to said engine to create a flow of said external air in said annular passage toward said air outlet end to mix with said exhaust gases flowing from said holes.

17. An exhaust muffler for an internal combustion engine comprising:

a tapered tube including:

an exhaust inlet end exhibiting a first diameter and configured to receive exhaust gases;

an exhaust outlet end exhibiting a second diameter, said second diameter being less than said first diameter; and a wall portion located between said exhaust inlet end and said exhaust outlet end, said wall portion having a plurality of holes, each of said holes being an ellipse having a major axis and a minor axis, said major axis being greater than said minor axis, and said major axis being substantially aligned with a longitudinal dimension of said tapered tube; and an outer tube axially aligned with and surrounding said tapered tube to form an annular passage between said tapered tube and said outer tube, said outer tube having an air inlet end proximate said exhaust inlet end and an air outlet end proximate said exhaust outlet end, said air inlet end being configured to receive air external to said engine to create a flow of said external air in said annular passage toward said air outlet end to mix with said exhaust gases flowing from said holes.

18. An exhaust muffler as claimed in claim 16 wherein:

a first subset of said holes is arranged in a first row encircling a circumference of said tapered tube; and a second subset of said holes is arranged in a second row encircling said circumference of said tapered tube, said second row being offset relative to said first row such that center points of said holes of said second subset are shifted about said circumference relative to center points of corresponding ones said holes of said first subset.

19. An exhaust muffler as claimed in claim 16 wherein:

said outer tube extends downstream from said exhaust outlet end of said tapered tube to form a region delineated by said exhaust outlet end, said air outlet end, and an inner surface of said outer tube; and said region exhibits a downstream gas pressure that is less than an upstream gas pressure in said tapered tube proximate said exhaust inlet end.

20. An exhaust muffler for an internal combustion engine comprising:

a tapered tube including:

an exhaust inlet end exhibiting a first diameter and configured to receive exhaust gases from said engine;

an exhaust outlet end exhibiting a second diameter, said second diameter being less than said first diameter; and a wall portion located between said exhaust inlet end and said exhaust outlet end, said wall portion having a plurality of holes; and an outer reducing tube removably secured to said tapered tube, said outer reducing tube being axially aligned with and surrounding said tapered tube to form an annular passage between said tapered tube and said outer reducing tube, said outer reducing tube including:

an air inlet end proximate said exhaust inlet end and exhibiting a first tube diameter for receiving air external to said engine to create a flow of said external air in said annular passage; and an air outlet end proximate said exhaust outlet end and exhibiting a second tube diameter, said second tube diameter being less than said first tube diameter, said outer tube extending downstream from said exhaust outlet end of said tapered tube to form a low pressure region delineated by said exhaust outlet end, said air outlet end, and said inner surface for accelerating the receipt of said exhaust gases from said engine.

* * * * *